United States Patent [19]

Quinci

[11] Patent Number: 5,042,380

[45] Date of Patent: Aug. 27, 1991

[54] METHOD AND APPARATUS FOR PREVENTING MISREGISTRATION BETWEEN PLATE AND BLANKET CYLINDERS OF A SHEET TYPE PRINTING PRESS

[75] Inventor: Emanuel Quinci, Dix Hills, N.Y.

[73] Assignee: Halm Industries Co., Inc., Glen Head, N.Y.

[21] Appl. No.: 415,129

[22] Filed: Sep. 28, 1989

[51] Int. Cl.[5] ..... B41F 13/14; B41F 5/22

[52] U.S. Cl. ..... 101/217; 101/248; 101/486

[58] Field of Search ..... 101/248, 181, 216, 485, 101/486; 74/395, 396, 398, 399, 640, 675

[56] References Cited

U.S. PATENT DOCUMENTS 3,565,006 2/1971 Stewart ..... 101/248

3,724,368 4/1973 Treff ..... 101/248

4,072,104 2/1978 Schaffer ..... 101/248

4,363,270 12/1982 Ury et al. ..... 101/248

*Primary Examiner*—J. Reed Fisher

*Attorney, Agent, or Firm*—Hoffmann & Baron

[57] ABSTRACT

A sheet type printing press is disclosed which includes a transmission assembly that prevents misregistration of plate and blanket cylinders upon their separation. The assembly also permits the press to be advanced or retarded while running to either correct misregistration or to start a new job using the same plate cylinders. A double harmonic drive is used to advance or retard the press. The harmonic drive is mounted to a hub which causes one of the circular splines and flexsplines thereof to be maintained under constant load. Such loading prevents misregistration when the plate cylinder drive gear is disengaged.

4 Claims, 3 Drawing Sheets

METHOD AND APPARATUS FOR PREVENTING MISREGISTRATION BETWEEN PLATE AND BLANKET CYLINDERS OF A SHEET TYPE PRINTING PRESS

BACKGROUND OF THE INVENTION

The field of the invention relates to sheet presses for printing individual documents or other articles.

Two types of printing presses are generally well known to the printing industry, these being web presses and sheet presses. The former is used primarily for continuously printing a roll or web of paper or other substrate. The web is subsequently cut to desired lengths. The latter type of press is used for printing individual, pre-cut documents, envelopes or other articles.

A sheet press generally comprises one or more plate cylinders, a blanket cylinder, and an impression cylinder. One of the plate cylinders is typically driven by a power source. A gear drive is provided for coupling these two elements. Ink is provided to the etched plate mounted to the outer surface of the plate cylinder. This ink is transferred by the engagement of the outer surfaces of the plate and blanket cylinders, the latter having an outside surface defined by ink receptive blanket material The paper to be printed passes between the blanket and impression cylinders. A precise gearing arrangement maintains the relative positions of the plate and blanket cylinders when the press is in operation.

A problem occurs in sheet presses when a document is not fed and the plate and blanket cylinders must be separated. Such separation, known as the "off impression" mode, is necessary as too much ink will accumulate on the blanket cylinder if the press is allowed to keep running at this time. However, separation of the cylinders is only accomplished through separation of the gear train which joins these two elements.

Another drawback of presently known sheet presses is the inability to advance or retard the press while it is running. This is due to the fact that the gearing must be so precise that play that would permit such adjustment cannot be allowed. Devices known as indexers are accordingly employed to advance or regard the press while in it is in the static mode. A full 360° of adjustment is possible by using such indexers. Another alternative is to employ a pair of helical gears which are axially displaced with respect to each other. A major disadvantage of this approach is that the plate cylinder can only be displaced by a very limited amount.

SUMMARY OF THE INVENTION

It is an object of the invention to provide a sheet press including a blanket cylinder, a plate cylinder, and means for separating the blanket and plate cylinders without causing misregistration of the two upon their reengagement.

It is another object of the invention to provide a sheet press including means for advancing or retarding the press while it is running.

In accordance with these and other objects of the invention, a sheet type printing press is provided which includes a blanket cylinder, a plate cylinder, means for driving the plate cylinder, the driving means including means for rotationally displacing the plate cylinder with respect to the blanket cylinder while the driving means is in operation, thereby advancing or retarding the image to be printed.

In accordance with a preferred embodiment of the invention, driving means including a harmonic drive are provided for driving the plate cylinder. The circular and dynamic splines of the harmonic drive are maintained under load to prevent misregistration when the blanket and plate cylinders are separated. The harmonic drive allows the press to be retarded or advanced, thereby correcting any misregistration. It also permits the operator to change from one job to another while the press continues to run, simply by causing relative rotation between the plate cylinder shaft and the plate cylinder drive gear.

A method for preventing misregistration of the plate and blanket cylinders of a sheet type printing press is also provided by the invention, the method including the steps of maintaining the circular spline and flexspline of a harmonic drive under load while the cylinders are disengaged from each other.

DETAILED DESCRIPTION OF THE INVENTION

Figure 1:
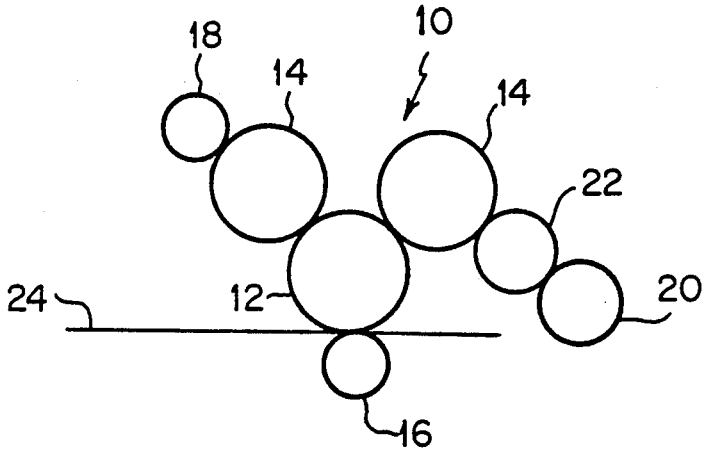
FIG. 1 is a schematic illustration of a sheet type printing press in accordance with the invention.
Figure 4:
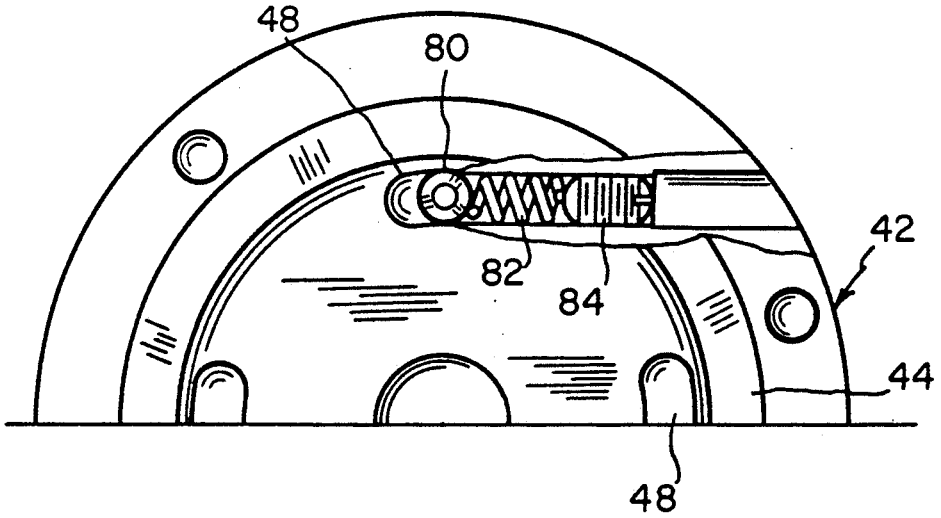
FIG. 4 is an enlarged, front elevation view of an assembly for maintaining the circular and dynamic splines of a harmonic drive under constant load.

A sheet type printing press 10 as shown in FIG. 1 is provided by the invention. The press includes a blanket cylinder 12, one or more plate cylinders 14, and an impression cylinder 16. Each of the plate cylinders includes a cylindrical surface provided with one or more etchings. A form roller 18 or the like provides ink to the plate cylinder which, in turn, transfers it to the blanket cylinder 12. Each plate cylinder typically transfers a different color ink to the blanket cylinder.

The plate cylinders may be driven in a number of ways. In the embodiment shown in FIG. 1, a drive gear 20 connected to a motor (not shown) drives an idler gear 22 which, in turn, drives one of the plate cylinders. This plate cylinder drives the blanket cylinder while the blanket cylinder drives the other of the two plate cylinders.

The substrate 24 to be printed is passed between the blanket and impression cylinders. Sheet presses are designed for printing pre-cut articles such as paper envelopes. Each article receives a precisely metered amount of ink from the blanket cylinder in a precise location. The plate cylinders and blanket cylinder are all rotated by interengaged drive gears which maintain their alignment as the press is running. Since all of the interconnected gears are under load in operation, there is little chance of the cylinders becoming displaced with respect to each other and causing the images imparted to the blanket cylinder to be misregistered. However, such misregistration can easily occur should it become necessary to separate the plate and blanket cylinders. Separation is necessary when a document is not fed for any reason.

It is also advantageous to be able to rotationally advance or retard the plate cylinders with respect to the blanket cylinder without having to shut down the press. This allows the operator to correct small errors in registration almost instantaneously. It further allows the operator to move quickly to a different job by simply rotating the plate cylinders so that a different etching thereon will be imparted to the blanket cylinder and then printed upon the substrate 24. About ten different images can be etched upon a typical plate cylinder, which would allow ten different jobs to be performed sequentially without having to shut the press off.

Harmonic drives are commercially available differential drive units used for the transmission of power. They are used for providing high ratio, in-line gearing and allowing shaft phasing. Such couplings have heretofore been impractical for sheet type presses as there is far too much play therein.

Figure 2:
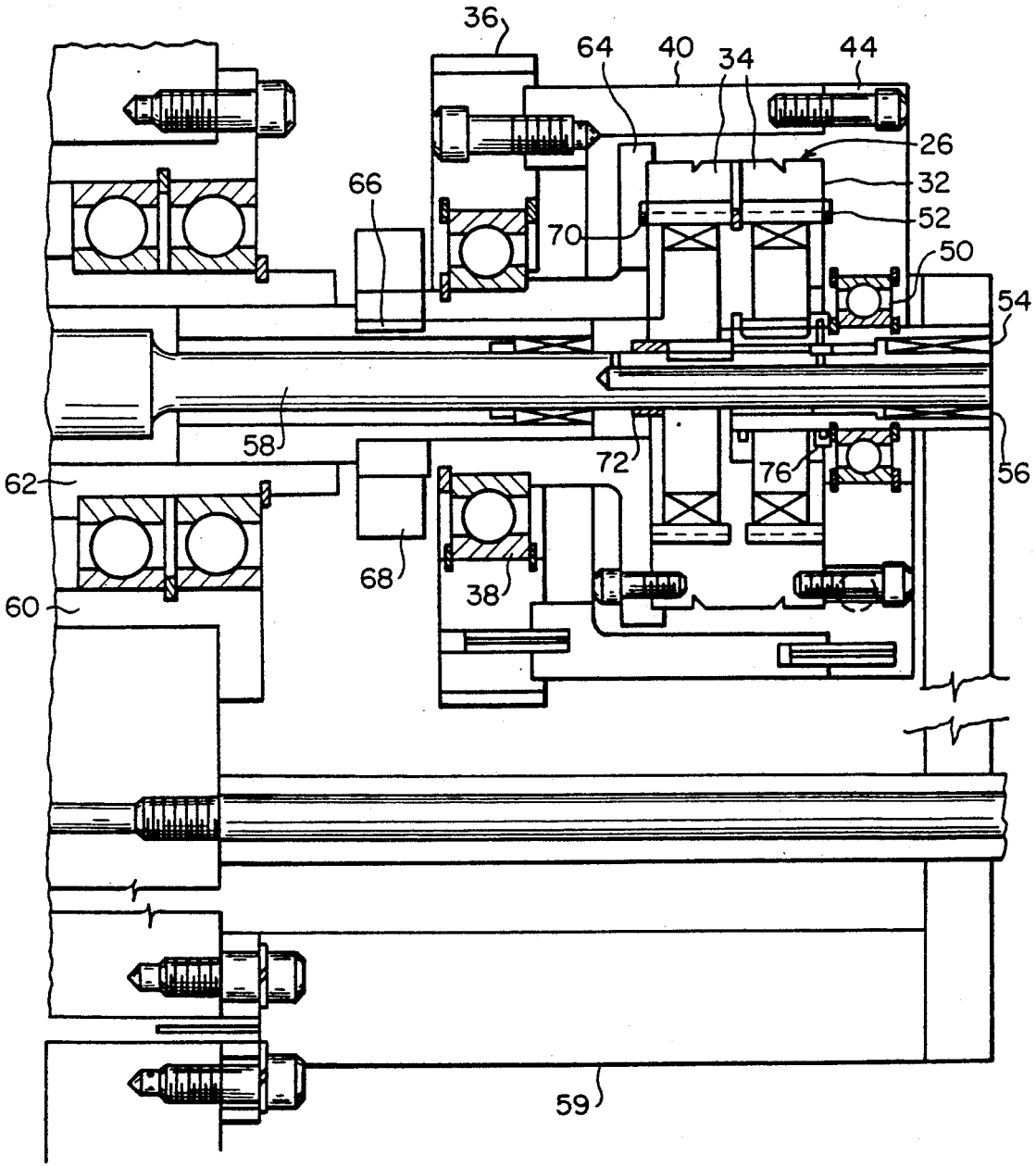
FIG. 2 is a sectional side elevation view of a portion of said press.
Figure 3:
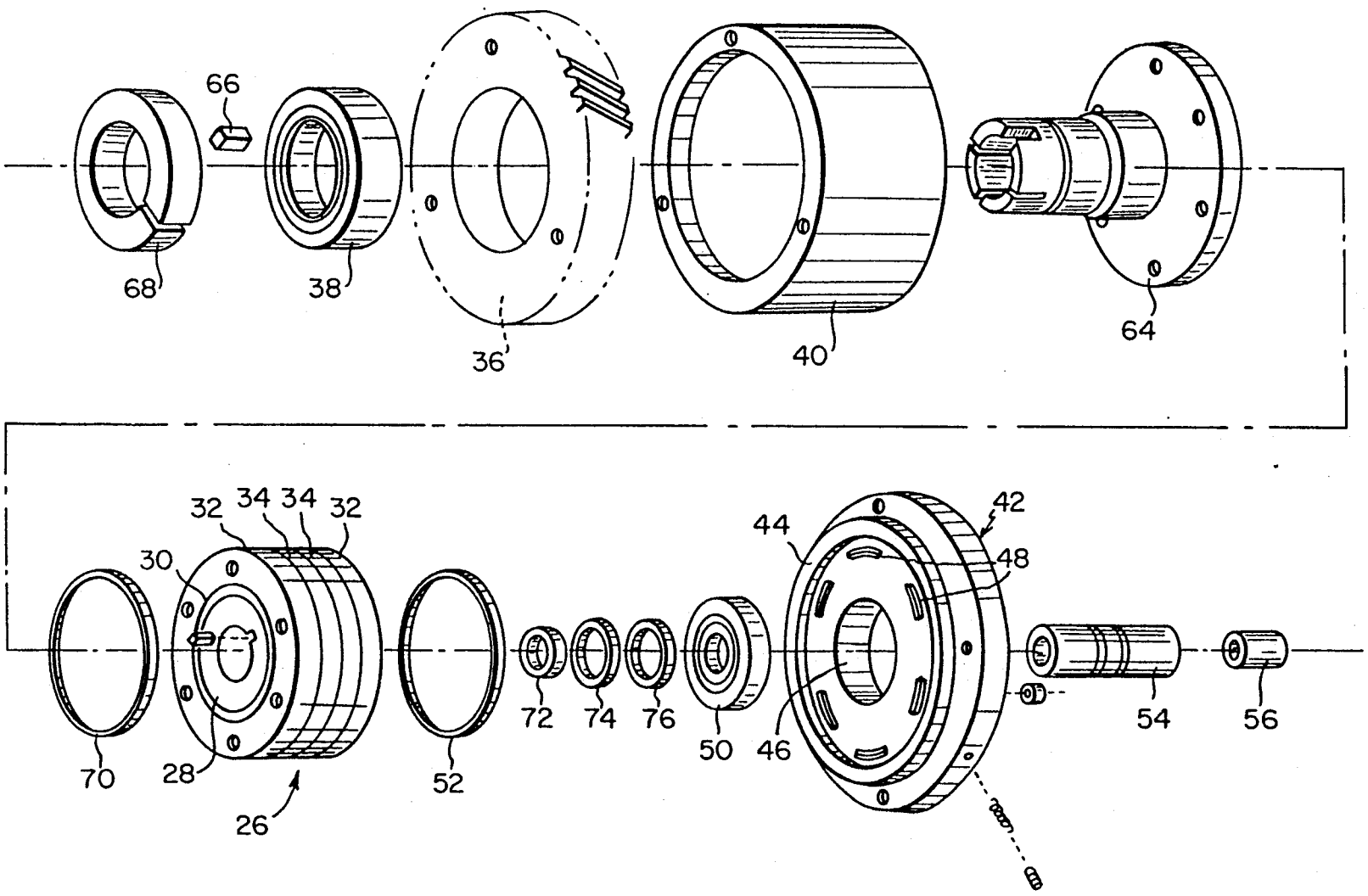
FIG. 3 is an exploded, perspective view of an assembly for driving a plate cylinder of said press.

Referring to FIGS. 2-3, the sheet press according to the invention employs a double harmonic drive assembly 26, which is a commercially available unit. The harmonic drive couples the plate cylinder 14 to the plate cylinder shaft as described below. This allows a differential coupling between the plate cylinder and the plate cylinder shaft. The assembly 26 includes first and second wave generators 28, first and second flexsplines 30, first and second circular splines 32, and first and second dynamic splines 34. The harmonic drive allows one of the plate cylinders 14 to be advanced or retarded in a manner to be explained later.

The assembly shown in FIG. 2 is driven by a gear (not shown) which engages the plate cylinder drive gear 36. The drive gear 36 is supported by a bearing 38 and secured to the harmonic drive housing 40. The harmonic drive housing is secured to a harmonic drive hub 42. The harmonic drive hub includes an axially projecting rim 44, a central bore 46, and six elongated slots 48 positioned within the rim. It is supported by a bearing 50 positioned within this bore. A ring 52 is positioned between the hub 42 and the wave generator of the harmonic drive 26 and provides a reduced friction surface therebetween.

A stub shaft 54 extends through the bearing 50 and is keyed to the wave generator of the harmonic drive 26 which is nearest to it. A bushing 56 mounted to a trim shaft 58 supports the stub shaft 54. This entire assembly is supported by a grounding clamp 59.

The trim shaft 58 is keyed to the other of the two wave generators 28 within the double harmonic drive 26. The trim shaft extends through the plate cylinder shaft 62, which drives one of the plate cylinders 14. The plate cylinder shaft is supported by bearings 60 at each end of the press. A hub 64, which functions as a harmonic drive assembly clamp, anchors the harmonic drive 26 to the plate cylinder shaft. A drive key 66 is provided for connecting the slotted, cylindrical end of this hub 64 to the plate cylinder shaft. A collar 68 is secured to the slotted end of the hub 64 as shown in FIG. 2.

A thrust ring 70 provides a frictionless surface between the harmonic drive 26 and the hub 64 adjacent thereto. Spacers 72, 74 and 76 are positioned as shown in FIG. 2 for taking up any play between the trim and stub shafts and the respective wave generators of the harmonic drive.

When the press is running, the drive gear 36 is engaged, and power is transmitted through the transmission assembly discussed above to the plate cylinder shaft 62. The drive gear 36, harmonic drive housing 40 and harmonic drive hub 44 all rotate in unison about the bearings 38, 50 which support them. One of the circular splines 32 of the wave generator is bolted to the harmonic drive hub, and accordingly rotates therewith. The other of the two circular splines is bolted to the second hub 64, which transmits power to the plate cylinder shaft 62. The rotation of the plate cylinder shaft 62 may be advanced or retarded by turning the trim shaft 58. The trim shaft, being keyed to one of the wave generators of the harmonic drive, turns the wave generator when such adjustment is desired.

One revolution of the trim shaft and associated wave generator causes the dynamic spline to rotate by 1/88 of a turn. Other ratios could alternatively be employed. More or less rotation may be provided depending upon the number of teeth in the various splines of the harmonic drive. The rotation of the hub 64 secured to the harmonic drive, and the plate cylinder shaft connected thereto, are thereby advanced or retarded by a fraction of a turn upon each rotation of the trim shaft. A wheel or other mechanism (not shown) may be secured to the end of the trim shaft for turning it manually or automatically. Since the gear ratio is high in a harmonic drive, there is no problem in turning the trim shaft even while the drive gear 36 is engaged and operating.

Upon disengagement of the drive gear 36, the play or "slop" in the power transmission assembly would likely cause misregistration between the plate and blanket cylinders upon their re-engagement. The harmonic drive hub 42 is accordingly constructed so that the teeth of the circular spline mounted thereto and the teeth of the flexspline associated therewith are always under load. As discussed above, the harmonic drive hub 42 includes elongated slots 48. The bolts connecting the adjoining circular spline 32 to this hub extend through these slots. A bore 78 is provided within the harmonic drive hub which extends from its exterior surface to one of the slots 48. A spacer 80 is positioned within the slot, and receives the bolt. An anti-backlash coil spring 82 is positioned within the bore 78 and extends into the slot where it resiliently urges the spacer in the drive direction. A set screw 84 is provided for adjusting the pressure applied by the spring.

The constant load applied to the harmonic drive allows it to be used in a sheet type press as virtually all of the play throughout the transmission assembly is removed. Misregistration which would otherwise occur when the load imparted from the engaged drive gear is removed, as in the "off impression" mode, is virtually eliminated.

It will be appreciated that more than two plate cylinders may be employed in a sheet press, each being used to transfer a different color ink. In order to correct for misregistration, it is important that at least all but one of the power transmission assemblies for rotating the plate cylinders be provided with the double harmonic drives used in accordance with the invention. This allows relative movement of each plate cylinder with respect to each other. If desired, all of the plate cylinder transmission assemblies may be equipped with harmonic drives. It is important that each of the harmonic drives be spring-biased to remove the play which would otherwise preclude their use in a sheet type printing press.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A sheet type printing press of the type used for printing discrete sheets of material, comprising:

a blanket cylinder;

a plate cylinder positioned adjacent to said blanket cylinder and engageable therewith;

means for driving said plate cylinder, said driving means including means for rotationally displacing said plate cylinder with respect to said blanket cylinder while said driving means is in operation, thereby rotationally advancing or retarding said plate cylinder with respect to said driving means;

said driving means including a plate cylinder drive gear, a plate cylinder shaft connected to said plate cylinder, a harmonic drive, means for anchoring said harmonic drive to said plate cylinder shaft, and means for connecting said drive gear with said harmonic drive so that said harmonic drive is rotated upon rotation of said drive gear;

said displacing means including means for rotationally displacing said plate cylinder with respect to the rotational position of said plate cylinder drive gear;

said harmonic drive including a wave generator, a flexspline engaging said wave generator, a dynamic spline engaging said flexspline, and a circular spline engaging said flexspline;

a harmonic drive hub including at least one elongated slot and a bore intersecting said slot, a bolt extending through said slot and securing said circular spline to said harmonic drive hub;

means for maintaining said engaged flexspline and circular spline under load at all times, including during separation of said plate and blanket cylinders, thereby preventing rotational displacement therebetween, said means for maintaining including a compressing spring exerting pressure against said bolt, thereby urging said circular spline in the drive direction of said driving means, and a set screw extending at least partially within said bore and bearing against said compression spring.

2. A press as defined in claim 1 wherein said harmonic drive is a double harmonic drive.

3. A sheet type printing press of the type used for printing discrete sheets of material, comprising:

a plate cylinder;

a blanket cylinder;

a plate cylinder drive gear;

means for rotatably mounting said plate cylinder drive gear;

a double harmonic drive including first and second circular splines engaging first and second flexsplines, respectively, first and second dynamic splines engaging said first and second flexsplines, respectively, and first and second wave generators engaging said first and second flexsplines, respectively;

means for constantly maintaining said engaged second circular spline and second flexspline under load, including during separation of said plate and blanket cylinders;

means for connecting said plate cylinder drive gear to said second circular spline including a harmonic drive hub, means for rotatably supporting said harmonic drive hub, said harmonic drive hub including an elongated slot and a bolt extending through said elongated slot and securing said second circular spline to said harmonic drive hub;

means for resiliently urging said bolt in a drive direction of said plate cylinder drive gear;

a plate cylinder shaft, said plate cylinder being secured to said plate cylinder shaft;

means for connecting said plate cylinder shaft and said first circular spline;

a trim shaft; and means for securing said trim shaft to said first wave generator, said first wave generator, first flexspline, first dynamic spline and first circular spline being constructed such that one revolution of said trim shaft causes said first dynamic spline to rotate a small fraction of a revolution about its axis.

4. A method for preventing misregistration between a plate cylinder and a blanket cylinder of a sheet type printing press of the type used for printing discrete sheets of material, said plate cylinder being rotatably mounted and engageable with said blanket cylinder, comprising the steps of:

providing a transmission assembly for transmitting power to said plate cylinder to cause rotation thereof about its axis, said transmission assembly including a harmonic drive including a wave generator, a flexspline supported by said wave generator, a dynamic spline engaged to said flexspline, a circular spline engaged to said flexspline, a harmonic drive hub including at least one elongated slot and a bore intersecting said slot, and a bolt extending through said slot and securing said circular spline to said harmonic drive hub;

separating said plate and blanket cylinders;

resiliently maintaining said circular spline and said flexspline under constant load during the separation of said plate and blanket cylinders by causing a compression spring to exert pressure against said bolt; and controlling the pressure exerted by said compression spring against said bolt by positioning a set screw within said bore and causing said set screw to bear against said compression spring.

* * * * *